United States Patent [19]

Pyles

[11] 3,939,958

[45] Feb. 24, 1976

[54] VARIABLE DISCHARGE SURGE FEEDER AND BOLTER

[75] Inventor: Harley G. Pyles, Fairmont, W. Va.

[73] Assignee: Mining Equipment Division of FMC Corporation, Fairmont, W. Va.

[22] Filed: Jan. 8, 1974

[21] Appl. No.: 431,796

[52] U.S. Cl. ..... 198/7 R; 198/57; 214/83.36; 299/11

[51] Int. Cl.[2] ..... B65B 65/02

[58] Field of Search ..... 198/113, 126, 7, 57, 58; 214/83.36, 522; 299/11

[56] References Cited

UNITED STATES PATENTS

| | | | |
|---|---|---|---|
| 854,734 | 5/1907 | Haines | 198/57 |
| 2,274,313 | 2/1942 | Whaley | 214/83.36 |
| 3,190,369 | 6/1965 | Pyles | 173/23 |

*Primary Examiner*—Evon C. Blunk
*Assistant Examiner*—Douglas D. Watts
*Attorney, Agent, or Firm*—Stanley J. Price, Jr.

[57] ABSTRACT

Apparatus for the handling of dislodged particulate material within a mine includes a base member having ground traction means with a body member supported on the base member. Vertical side plates on opposed sides of the body member secured thereto define a longitudinal material receiving bin. An endless main conveyor located within the material receiving bin has a receiving end and a discharge end. The receiving end when used as a surge hopper is adapted to continuously receive material dislodged from an adjacent continuous mining machine. A delivery conveyor receives material from the discharge end of the main conveyor and discharges it into other conveying means such as a shuttle car or an endless belt conveyor. A portion of the main conveyor positioned adjacent the discharge end thereof moves or pivots upwardly about a transverse horizontal axis and thereby assumes a position for maximum discharge of the material. Another position is provided for terminating discharge of material and intermediate positions for intermediate rates of discharge. A sensing device is provided to determine the quantity of materials in the material receiving bin and control the elevation of a portion of the main conveyor to thereby regulate the rate of discharge in the material receiving bin and the angle of inclination of a portion of the main conveyor. The endless main conveyor operates continuously during the operation of the mining machine and continuously advances and distributes the load in the receiving bin and discharges material from the receiving bin only when a shuttle car is in material receiving position.

8 Claims, 7 Drawing Figures

24
26
32
34
36
38
48
84
86
88
90
B

VARIABLE DISCHARGE SURGE FEEDER AND BOLTER

BACKGROUND OF THE INVENTION

1. Field of the Invention

This invention relates to a variable discharge surge feeder and bolter for receiving, handling and discharging material received from a continuous mining machine and ultimately discharged to a shuttle car and more particularly to a system for continuously operating a material receiving conveyor while periodically interrupting the discharge of material therefrom corresponding with the shuttle car position.

2. Description of the Prior Art

Conventional modern continuous mining machines move progressively and continuously into a mine vein. As an integral part of such machines, a rearwardly moving conveyor accepts disintegrated material adjacent the face of the mine and transports it rearwardly through the mining machine for discharge at the rear end thereof. During the operation of the mining machine, the flow of this material emerging from the mining machine conveyor is continuous.

Material emerging from the mining machine is ultimately placed in a shuttle car, which when filled travels away from the mine area to be unloaded. A problem is created as a result of the mining machine at one end of this system operating continuously, while the shuttle car is available to accept materials only intermittently. If the mining machine is to be operated substantially continuously and thereby mine a maximum amount of material within a given time, it is necessary for compensation to be made in the material transporting system in order to avoid intermittent shutdowns during the travel and unloading period of the shuttle car. Without arranging for some compensating means, the continuously operating conveyor would simply discharge the mined material onto the mine floor during the time period within which the shuttle car was not in material receiving position.

One means of compensating for this time delay created by shuttle car handling is disclosed in U.S. Pat. No. 2,290,950 wherein an intermediate hopper car is positioned between the mining machine and the shuttle car and is adapted to receive mined material from the mining machine conveyor and ultimately transfer it to the shuttle car. The hopper car disclosed includes a transport conveyor and provides storage capacity for the disintegrated material being received during a period when discharge is not permitted. The car also has adjustable means by which the amount of material entering the storage area and the amount moving on to the shuttle car may be controlled. One disadvantage of the storage facility is that it requires the manual adjustment of an adjustable deck in order to control the volume of flow into the storage area. It, therefore, does not provide automatic means for adjusting flow into the storage compartment.

In U.S. Pat. No. 2,670,836 a material handling car is provided with two conveyors. In operation, the receiving conveyor transfers material to the discharge conveyor which, in turn, transfers the material to the shuttle car. Provision is made for shuttle car removal by stopping the receiving conveyor and speeding up the discharge conveyor to empty it. At that point the shuttle car may be removed and both conveyors are operated at a very slow speed to continue the transfer of material from the receiving to the discharge conveyor. This is accomplished at such a low speed, however, that no material leaves the discharge end of the discharge conveyor until the shuttle car has returned. Thus, this system provides for shuttle car travel and unloading by synchronized speed adjustments between the two conveyors. A similar system is illustrated and disclosed in U.S. Pat. No. 2,753,971 wherein a double receiving conveyor is provided in tandem. The second of these two conveyors discharges material into a small storage container which has a conveyor and ultimately transfers the material to a final discharge conveyor. In order to terminate discharge at the far end of the tandem conveyors, the conveyor located within the storage area is stopped. When the shuttle car has returned to its loading position, the intermediate conveyor is started once again.

A system employing a flight conveyor wherein periodic termination of discharge is sought to be effected is disclosed in U.S. Pat. No. 2,637,457. In this system a number of the flights are removed thereby providing for automatic termination of the discharge from the conveyor at a certain point within each revolution of the continuous conveyor. The removal of flights and the timed movement of the shuttle car with respect to the conveyor must, however, be very carefully coordinated. The system has the disadvantage of being relatively inflexible.

There is need for an apparatus for the handling of dislodged particulate material which coordinates the continuous delivery of disintegrated material from the mining machine with intermittent transmission to a shuttle car. While it has been suggested to provide intermediate storage capacity, the prior art systems require either a multiplicity of conveyors and either stoppage of one conveyor or coordinated speed changes of the respective conveyors with respect to each other and the shuttle car.

SUMMARY OF THE INVENTION

This invention relates to an apparatus for the handling of disintegrated material which includes a base member having ground traction means. An elongated body member is supported on the base member and vertical plate members are secured to opposed sides of the body member. The body member and the vertical plate members cooperate to define a material receiving bin. A continuous conveyor is positioned within the material receiving bin and includes a material receiving end portion and a material discharge end portion. The continuous conveyor is adapted to receive material from a supply mechanism at the receiving end portion. A delivery mechanism is provided to receive material from the discharge end portion of the continuous conveyor, and a pivotal section of the continuous conveyor positioned adjacent the delivery mechanism is arranged to pivot upwardly about a horizontal transverse axis. The pivotal section is arranged during continuous operation of the conveyor to assume a first position for discharging material to the delivery mechanism and a second position for preventing discharge of the material from the continuous conveyor. The pivotal section in the first position assumes a smaller angle with respect to the horizontal than the second position and further means are provided for rotating the pivotal section.

A sensing device is provided whereby the depth of material on the conveyor is measured. The pivoted position of the pivotal section may be coordinated responsively to the depth of material on the conveyor and indicated by the sensing device. With this arrangement, the pivotal section may also be employed to adjust the rate of discharge from the material receiving conveyor to an intermediate position between discharge at full rate and termination of discharge. After return of the shuttle car to the material receiving position, the pivotal section may be pivoted downwardly to resume discharge of the material.

Accordingly, the principal object of this invention is to provide a material handling hopper operable to operate intermediate a continuous mining machine and a shuttle car.

Another object of this invention is to provide apparatus for the handling of disintegrated material which includes a continuously operating material receiving conveyor arranged to continuously receive material from the mining machine and automatically, periodically terminate discharge of material therefrom by pivoting of a section of the conveyor upwardly.

Another object of this invention is to provide a hopper car having a continuously operating material receiving conveyor adapted for continuous receipt of mined material from a mining machine, intermittent discharge of the material to an adjacent shuttle car and periodic termination of the discharge of material therefrom.

Another object of this invention is to provide a hopper car having a continuously moving conveyor provided with integral means for adjusting the rate of material discharge from the hopper car without altering speed of movement of the conveyor.

Still another object of this invention is to provide a hopper car having a continuously operating conveyor continuously receiving material from an adjacent mining machine and having a pivotal section adapted to rotate upwardly to reduce the rate of discharge of the material and, if desired, terminate discharge of material responsive to the position of the coordinating shuttle car.

An additional object of this invention is to provide a hopper car having sensing means positioned above the conveyor in order to measure the amount of material on the conveyor and position the pivotal section of the conveyor responsive to the measurement of the amount of material present.

A still further object of this invention is to provide apparatus for the automatic reduction or termination of the discharge of material from a continuously moving hopper car conveyor in order to provide maximum output from a continuously operating mining machine and avoid spillage of the mined material on the mine floor.

These and other objects of this invention will be more completely described and disclosed in the following specification, the accompanying drawings and the appended claims.

DESCRIPTION OF THE PREFERRED EMBODIMENTS

Figure 1:
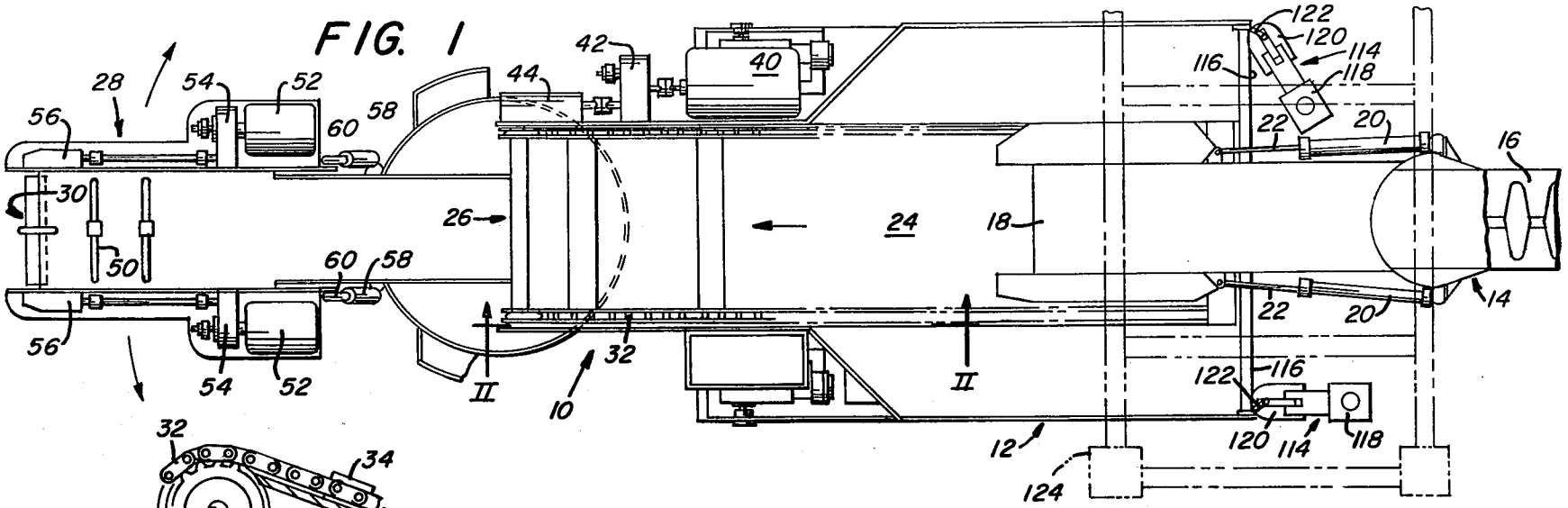
FIG. 1 is a top plan view of the variable discharge surge feeder and bolter, illustrating the operation of this invention in combination with a continuous mining machine.
Figure 7:
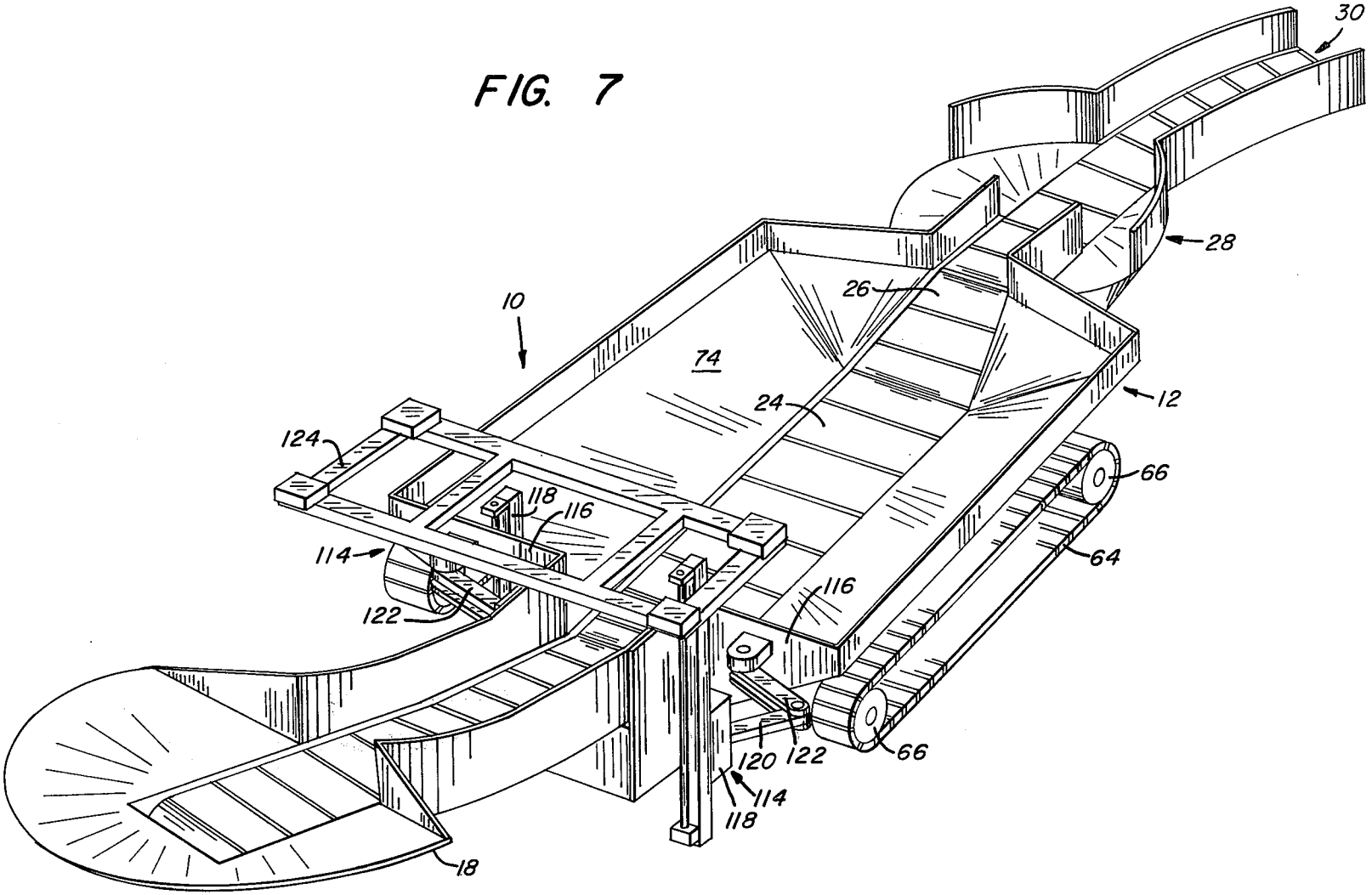
FIG. 7 is a perspective view of the variable discharge surge feeder and bolter, illustrating the canopy support frame and the auxiliary conveyor operatively associated with the hopper car.

Referring to the drawings, and more particularly to FIG. 1, there is illustrated a variable discharge surge feeder and bolter generally designated by the numeral 10 having a hopper car 12 positioned adjacent a continuous mining machine 14. Only a portion of the continuous mining machine 14 is shown in FIG. 1, and it may be of any conventional type which disintegrates bands of material, such as coal, from the face and delivers the disintegrated material to a delivery point by conveyor or shaker means. The loose material disintegrated from the face is accumulated on the mine floor and is picked up by the mining machine conveyor 16. The mining conveyor 16 extends longitudinally through the continuous mining machine 14 and transports the material rearwardly away from the mine face. The disintegrated material is transferred from the mining machine conveyor 16 to the auxiliary mining machine conveyor 18 which projects rearwardly from the mining machine conveyor 16 and the continuous mining machine 14. The auxiliary mining machine conveyor 18 is arranged in overlying relationship with the hopper car 12. Alternatively, the auxiliary conveyor 18 may be operatively associated with the hopper car 12 and independent of the mining machine 14, as illustrated in FIG. 7. Hydraulic cylinders 20 having extensible pistons 22 positioned therein are mounted on the continuous mining machine 14 and are arranged to control the extent to which the auxiliary conveyor 18 overhangs the hopper car 12. The extent to which the auxiliary conveyor 18 overlies the hopper car 12 provides for uniform spreading of the disintegrated material conveyed from the mining face in the hopper car 12.

The hopper car 12 includes a main receiving conveyor 24 that receives material discharged from the auxiliary conveyor 18. The main receiving conveyor 24 includes a discharge end portion 26 that is arranged in overlying relationship with the delivery conveyor 28 that is pivotally secured to the rear end portion of the hopper car 12 for receiving material from the discharge end portion 26 of conveyor 24. A shuttle car (not shown) is adapted to be moved under the discharge end 30 of the delivery conveyor 28 and is filled with disintegrated material being deposited from the delivery conveyor 28. When the shuttle car is filled with material collected from the delivery conveyor 28, the flow of material through the hopper car 12 of the variable discharge surge feeder and bolter 10 is terminated, in a manner to be described hereinbelow. The shuttle car then travels to a discharge point where the material is unloaded onto a main conveyor system for transfer of the material out of the mine. After unloading, the shuttle car returns to its position underlying the delivery conveyor 28 for further loading at which time the transfer of material to the shuttle car is resumed.

Figure 2:
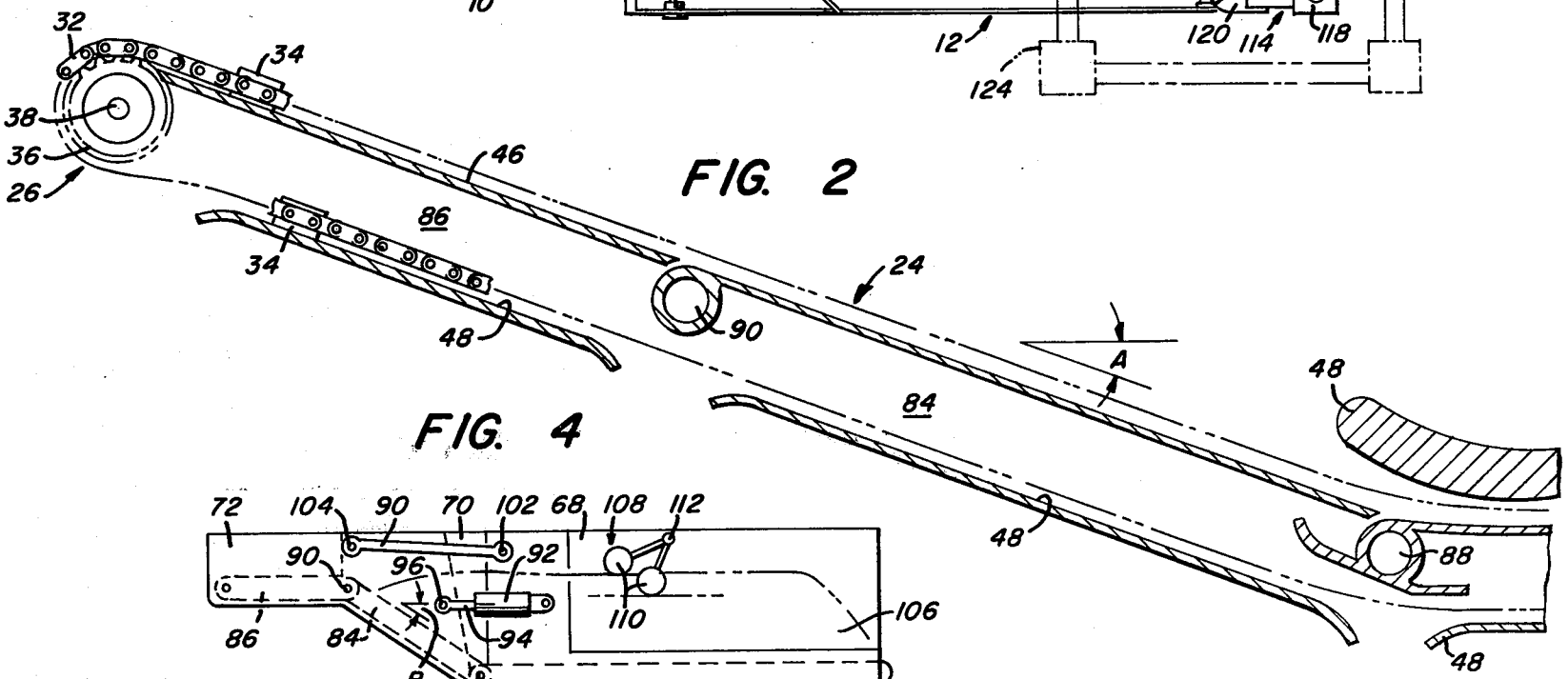
FIG. 2 is a sectional view of the present invention taken along the line II—II of FIG. 1, illustrating the receiving conveyor in the material discharging position.

As illustrated in FIGS. 1 and 2 of the drawings, the main receiving conveyor 24 contains an endless chain 32 comprising a plurality of conveyor flights 34. The endless chain 32 passes over a driven sprocket 36 that is rigidly secured to a shaft 38. Motor 40 is connected to shaft 38 through gear reducers 42 and 44. Thus, the motor 40 drives the sprocket 36 to continuously move the conveyor flights 34 of the endless chain 32 over the surface of plate 46. The surface of plate 46 should be substantially continuous and wear resistant to permit gliding of the conveyor flights 34 thereover. Furthermore, the plate 46 serves to support the conveyor flights 34 as they are moved by the driven sprocket 36. A plurality of chain hold-down members 48 are provided to assure substantially continuous contact between the conveyor flights 34 of the endless chain 32 and the surface of plate 46.

The delivery conveyor 28 positioned in underlying relationship with the discharge end portion 26 of the main receiving conveyor 24 is a flight type conveyor having double flights 50 comprising the endless chain (not shown) of the conveyor. The endless chains of the delivery conveyor 28 pass over sprockets (not shown) that are driven by the motors 52 through the gear reducers 54 and 56. Hydraulic cylinders 58 having extensible pistons 60 provided therein are laterally mounted opposite one another on the delivery conveyor 28. Operation of the hydraulic cylinders 58 extends and retracts the pistons 60 to thereby swing the delivery conveyor 28 in the direction indicated by the arrows for positioning the discharge end 30 in overlying relationship with the shuttle car.

In the preferred embodiment of the present invention the shuttle car is initially positioned relative to the discharge end 30 so that disintegrated material is transferred to the far end of the shuttle car. Then the shuttle car is moved forwardly as it is progressively loaded with material. In this fashion, the material is uniformly distributed in the shuttle car. On the other hand, the shuttle car may be stationaryily positioned relative to delivery conveyor 28. The delivery conveyor 28 is then retracted from an extended position to distribute the material uniformly in the shuttle car thereby facilitating the loading operation.

Figures 3, 5, 6:
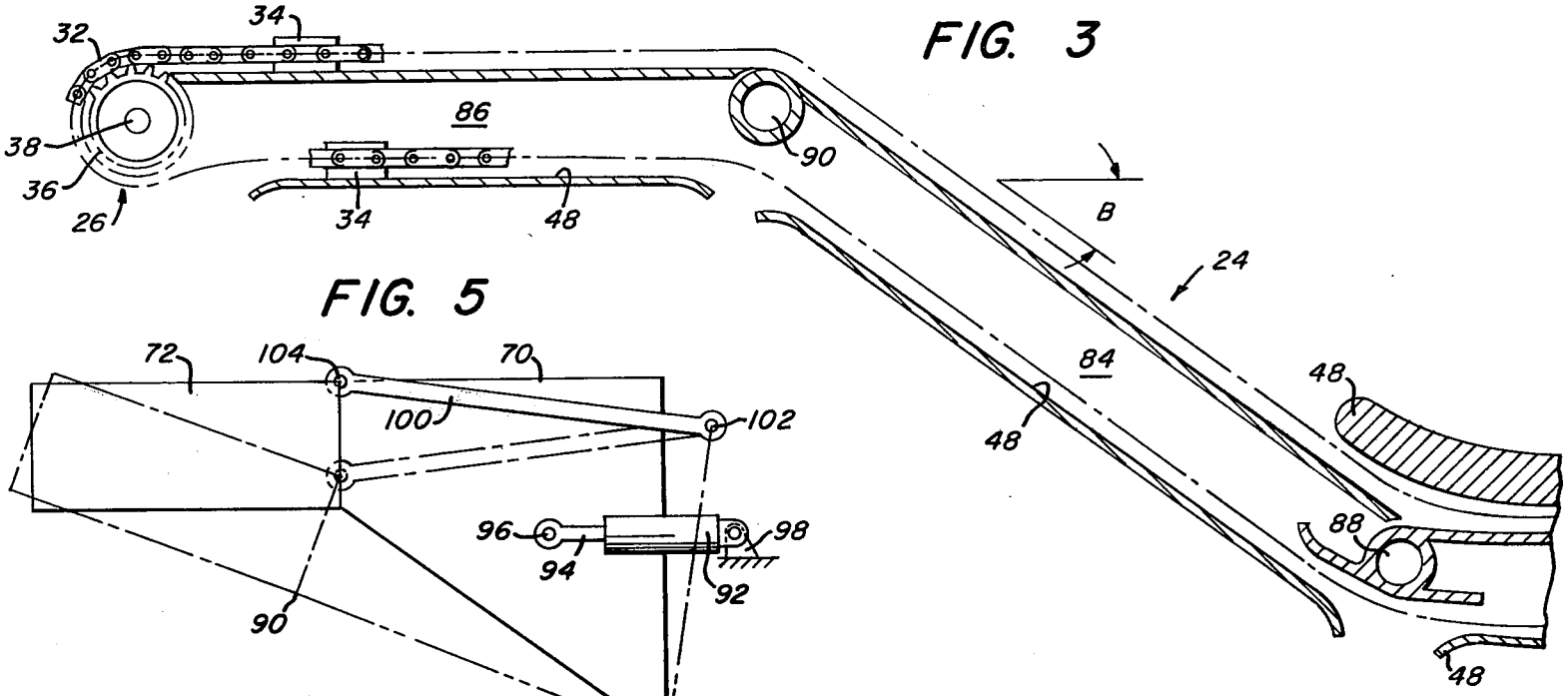
FIG. 3 is a view similar to FIG. 2 and illustrates the receiving conveyor in the position for terminating flow of material out of the hopper car.
FIG. 5 is a schematic representation of a portion of the hopper car shown in FIG. 4 and illustrates the mechanical operation of a portion of the hopper car according to the present invention.
FIG. 6 is a schematic representation in side elevation illustrating another embodiment of the present invention.

Referring to FIG. 6 of the drawings, there is illustrated another embodiment of the hopper car 12 that includes a main body portion 62 mounted on and supported by the ground engaging tractor treads 64 passing around the driven sprockets 66. Secured to the opposite sides of the main body portion 62 of the hopper car 12 are vertical plate members 68, 70, 72 arranged to form a material receiving bin 74 within which the main receiving conveyor 24 is positioned. The plate members 68, 70, 72 serve to prevent lateral movement of the material being transported by the main receiving conveyor 24. As the main receiving conveyor 24 moves, the conveyor flights 34 transport the material forward; while the vertical plate members 68, 70, 72 prevent transverse movement of the material out of the conveying path.

When the shuttle car is positioned in underlying relationship with the delivery conveyor 28, the disintegrated material will be continuously transported from the auxiliary mining machine conveyor 18 to the main receiving conveyor 24 of the hopper car 12. The material is ultimately discharged at the discharge end portion 26 of the conveyor 24 onto the delivery conveyor 28 from which the material is loaded into the shuttle car. Once the shuttle car is filled, it travels to its discharge station. If the mining operations are not to be terminated while the shuttle car is traveling to its discharge station, it is necessary to terminate the flow of material from the delivery conveyor 28 to avoid piling the material on the mine floor.

As illustrated in FIG. 6, the flow of material is terminated from the delivery conveyor 28 by operation of a pivotal arcuate section 76 provided within conveyor 24. The arcuate section 76, as shown in solid lines in FIG. 6, is in the position for normal discharge of material onto the delivery conveyor 28; while, the position shown in dotted lines illustrates the arcuate section 76 arranged for terminating flow of material off the delivery conveyor 28. The arcuate section 76, having a generally upwardly convex configuration as illustrated in FIG. 6, is arranged for pivotal movement about the shaft 78. With the arcuate section 76 in the upper portion shown by the dotted lines, the main receiving conveyor 24 continues to move; however, the inclination of the arcuate section 76 prevents the discharge of material from conveyor 24 onto the delivery conveyor 28. Thus, the continuous mining machine 14 functions to operate without interruption, and the material supplied by the conveyor 18 is transferred to the material receiving bin 74 until such time as the shuttle car returns to its material receiving position in underlying relation with the discharge end 30 of the delivery conveyor 28. With the shuttle car in a material receiving position, the arcuate section 76 is returned to its discharge position and movement of the material to the shuttle car is resumed.

Movement of the arcuate section 76 is accomplished by operation of the hydraulic cylinder 79 provided with the extensible piston 80 illustrated in FIG. 6. One end of piston 80 is pivotally connected to a bracket 82 that is mounted to the vertical plate 70. As piston 80 retracts into the hydraulic cylinder 79, the arcuate section 76 is pivoted upwardly about shaft 78. As piston 80 is extended from cylinder 78, the arcuate section 76 is pivoted downwardly about shaft 78. Additionally, in order to provide a reduced rate of flow of material through the hopper car 12, the arcuate section 76 may be stopped at an intermediate position between the upper and lower position of the arcuate section 76, as illustrated in FIG. 6.

The angle of inclination of the arcuate section 76 with respect to the horizontal when the section is in the position for terminating material flow depends upon the amount of material being stored within the material receiving bin 74, the speed at which the main receiving conveyor 24 is supplying additional material and the period of time during which the shuttle car will not be in material receiving position relative to the delivery conveyor 28. With this arrangement, the continuous mining machine 14 may continue to operate and supply the disintegrated material to the hopper car 12 regardless of the position of the shuttle car. In addition, the main receiving conveyor 24 may continue to move at a preselected speed regardless of the position of the shuttle car. The arcuate section 76 is independently controllable to initiate and terminate, as well as regulate, the flow of material out of the hopper car 12.

As illustrated in FIG. 6, the arcuate section 76 is positioned at the end of the main receiving conveyor 24; however, in the embodiment illustrated in FIG. 2, the arcuate section 76 is positioned adjacent to and spaced from the discharge end portion 26 of the main receiving conveyor 24. In FIG. 2 the main receiving conveyor 24 is disposed for normal continuous flow of the disintegrated material from the continuous mining machine 14 to the shuttle car. The main receiving conveyor 24 illustrated in FIG. 2 includes a pivotal section 84 positioned adjacent the end conveyor section 86. The pivotal section 84 forms an angle A with respect to the horizontal as material is permitted to be discharged from the main receiving conveyor 24. In the position illustrated in FIG. 3, however, the pivotal section 84 has assumed an angle B with respect to the horizontal thus preventing discharge of material from the main receiving conveyor 24.

In FIG. 2 the end conveyor section 86 also forms an angle A with respect to the horizontal, and FIG. 3 the end conveyor section 86 assumes a substantially horizontal position. Accordingly, in order to reduce the rate of flow of material in the hopper car 12, the pivotal section 84 may be pivoted about an angle less than angle B but greater than angle A. With this arrangement, a versatile means is provided to vary the rate of flow of material in the hopper car 12 between the position of the main receiving conveyor 24 for discharge of the material and termination of discharge of the material.

In moving either upwardly or downwardly, pivotal section 84 rotates about the fixed pivot member 88, and end conveyor section 86 rotates about moving pivot member 90. Referring to FIG. 5, there is illustrated the hydraulic cylinder 92 provided with an extensible piston 94 that is secured to the vertical plate member 70 at a pin 96. The hydraulic cylinder 92 is mounted to a bracket 98. Retraction of the piston 94 within the hydraulic cylinder 92 produces upward rotation of pivotal section 84 about fixed pivot member 88 and upward angular movement of the moving pivot member 90 with end conveyor section 86 rotating downwardly about moving pivot member 90.

Figure 4:
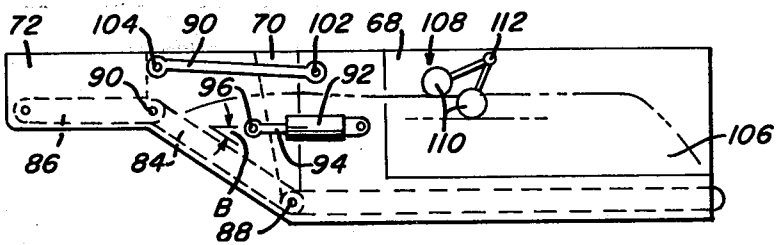
FIG. 4 is a schematic representation in side elevation, illustrating the hopper car according to the present invention.

The solid rectangular representation of the vertical plate member 72 in FIG. 5 indicates the position of the vertical plate member 72 when the main receiving conveyor 24 is in the position terminating discharge as shown in FIGS. 3 and 4. A rigid arm member 100 is pivotally connected to the fixed pivot member 102 and the other end of arm member 100 is pivotally mounted to the connection member 104 on the vertical plate member 72. As piston 94 extends from and retracts within the hydraulic cylinder 92 to rotate pivotal section 84, the arm member 100 pivots about the fixed pivot member 102 to thereby guide end conveyor section 86 and its rotational movement about moving pivot member 90.

The inclination of the pivotal section 84 at the angle B required to effectively terminate discharge of material from the main receiving conveyor 24, while continuing movement of the conveyor 24 at the same speed, is dependent upon the amount of material present within the hopper car 12. FIG. 4 schematically illustrates the hopper car 12 having a stored quantity of disintegrated material 106. A sensing device 108 includes a rotatable member 110 pivotally mounted about point 112 and is adapted to rotate upwardly or downwardly, as the level of disintegrated material within the hopper car 12 changes. The sensing device 108 or any other suitable material sensing device is provided within the material receiving bin 74 of the hopper car 12 and is operable to control the upwardly pivoting pivotal section 84 through the extension and retraction of piston 94 relative to the hydraulic cylinder 92.

Suitable automatic control means (not shown) receives an indication of the material level within hopper car 12 from sensing device 108 and actuates the hydraulic cylinder 92 to extend and retract piston 94. As illustrated in FIG. 4, the rotatable member 110 of the sensing device 108 is shown as having moved from a lower position to a higher position in response to an increase in the depth of disintegrated material 106 in the hopper car 12. Consequently, in response to the movement of the sensing device 108, the piston 94 retracts further into the hydraulic cylinder 92 to thereby position the pivotal section 84 at angle B with respect to the horizontal and terminate flow of the material out of the hopper car 12.

To permit installation of roof bolts as part of the mining cycle, a pair of roof drilling units 114 are rotatably mounted to opposed sides of forward end 116 of the hopper car 12, as illustrated in FIGS. 1 and 7. Each of the roof drilling units 114 includes a drill 118 having a drill steel mounted therein. A drill bit is secured to the end of the drill steel, and a hydraulic motor rotates the drill steel and drill bit. The drill 118 which may be either a percussion or percussion rotary drill is connected to a boom member 120 which, in turn, is pivotally connected to the forward end 116 of the hopper car 12 by the arm member 122. Suitable linkage means (not shown) is provided to maintain the drill 118 level with its drill shaft vertical axis as the boom member 120 constantly changes its angular position and moves upwardly through a vertical plane. A canopy support frame 124 is secured to the hopper car 12 and is positioned above the drilling units 114. The frame 124 supports a canopy such as an expanded metal screen (not shown) which functions to protect the drill operator from the hazard of falling rock material during the drilling operations.

The roof drilling units 114 function to drill holes a preselected depth into the mine roof for the installation of roof bolts as the continuous mining machine 14 disintegrates bands of material from the face. The positioning of the drilling units 114 at the forward end 116 of the hopper car 12 in proximate relationship to the continuous mining machine 14 provides for installation of roof bolts adjacent the face to thereby provide roof support adjacent the face. Preferably, the drilling units 114 will drill bolt holes in the mine roof on four or five foot centers without moving the hopper car 12 subject only to the limitation of the speed of the mining cycle and the physical dimensions of the mining machine.

Further, in accordance with the present invention, the main receiving conveyor 24 is continuously operated at a constant receiving speed regardless of whether or not material is being discharged from the discharge end portion 26 of the conveyor 24. When the shuttle car moves from its position adjacent the discharge end 30 of the delivery conveyor 28 and it is desired to terminate discharge from the main receiving conveyor 24 or alternatively when it is desired to reduce or alter the rate of flow from the conveyor 24, a pivotal section of the conveyor is rotated upwardly about a horizontal transverse axis. With this arrangement, continued movement of the main receiving conveyor 24 produces no discharge of disintegrated material therefrom. Subsequently, when it is desired to resume or increase the discharge flow from the conveyor 24, the pivotal section is pivoted downwardly to accomplish such discharge.

The continuous mining machine 14 may operate continuously at maximum output efficiency without being hampered by the intermittent nature of the operation of the shuttle car or delays encountered during the bolting operations. The operation of the hopper car 12 is greatly simplified by virtue of the fact that the conveyor speed may be maintained uniform without concern for coordinating the changes in relative conveyor speed with movement of the shuttle car. As described hereinabove, the pivotal movement of the pivotal section of the main receiving conveyor 24 is accomplished by operation of the hydraulic cylinder 92 in response to a signal received from the sensing device 108 positioned within the material receiving bin 74 and operable to sense the quantity of material therein.

Control of the flowrate of the disintegrated material from the main receiving conveyor 24 to the shuttle car is not limited to the pivotal movement of the pivotal section 84 between angles A and B, as illustrated in FIGS. 2 and 3. The rate of discharge of disintegrated material from the hopper car 12 to the shuttle car may also be controlled by initially maintaining the main receiving conveyor 24 at a speed sufficient to provide for continuous transfer of material from the mining machine 14 to the rear portion of the material receiving bin 74. When the shuttle car is in position adjacent the discharge end 30 of the delivery conveyor 28, the pivotal section 84 is rotated downwardly and the conveyor 24 operated at maximum speed. Operation of the delivery conveyor 28 is then commenced to quickly load the shuttle car.

When the car is fully loaded, conveyance of material from the hopper car 12 is terminated by shutting down the delivery conveyor 28. The speed of the main receiving conveyor 24 is then reduced, and the pivotal section 84 is rotated upwardly. With this arrangement the versatility of the variable discharge and surge feeder and bolter 10 may be expanded to meet a wide range of material handling requirements.

Operation of the pivotal section of the main receiving conveyor 24 is not dependent for accomplishment upon the hydraulic cylinders. Other conventional operating means may be employed, such as air cylinders or electric motors; however, the use of electric motors within mines is restricted to minimum use as required by the need to provide effective electrical shielding in order to reduce the risk of explosion. In addition, belt conveyors and other conventional conveying systems may be employed in place of the flight type conveyor system described hereinabove.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. An apparatus for handling disintegrated material including, a base member having ground traction means, an elongated body member supported on said base member, vertical plate members secured to opposite sides of said body member, said body member and said vertical plate members cooperating to define a material receiving bin, a continuous conveyor positioned within said material receiving bin, said continuous conveyor having a material receiving end portion, a material discharge end portion and a pivotal section positioned closer to said material discharge end portion than said material receiving end portion, said pivotal section arranged to pivot upwardly about a horizontal transverse axis and control the discharge of material from said discharge end portion, said continuous conveyor adapted to receive material at said receiving end portion of said continuous conveyor and convey the material longitudinally in said bin toward said material discharge end portion, said pivotal section arranged to pivot upwardly a sufficient distance to a first position so that during continuous operation of said conveyor said pivotal section substantially stops the discharge of said material from said material discharge end portion of said continuous conveyor while said continuous conveyor is in operation and other material is being conveyed from said material receiving end portion to said material discharge end portion, means for pivoting said pivotal section having at least one hydraulic cylinder, said pivotal section also arranged to pivot to a plurality of intermediate positions in addition to said first position for discharging said materials at preselected rates, sensing means positioned within said material receiving bin for indicating the quantity of said material within said bin, and said hydraulic cylinder responsive to the indication of the quantity of said material within said bin by said sensing means to position said pivotal section.

2. An apparatus for handling disintegrated material as set forth in claim 1 which includes, a delivery conveyor pivotally connected to said elongated body member and having a portion underlying said continuous conveyor when said pivotal section is in said first position, and said delivery conveyor extending upwardly and terminating in a portion arranged to overlie a conventional shuttle car during discharge of said material therefrom.

3. An apparatus for handling disintegrated material as set forth in claim 1 which includes, said pivotal section positioned adjacent said discharge end portion of said continuous conveyor.

4. An apparatus for handling disintegrated material as set forth in claim 1 which includes, said pivotal section positioned in spaced adjacent relation relative to said discharge end portion, and an end conveyor section disposed intermediate said pivotal section and said discharge end portion and arranged to rotate about a moving pivot positioned between said pivotal section and said end conveyor section.

5. An apparatus for handling disintegrated material as set forth in claim 3 which includes, said pivotal section having a generally upwardly convex configuration.

6. An apparatus for handling disintegrated material as set forth in claim 4 which includes, said end conveyor section arranged in a substantially straight line position with respect to said pivotal section when said pivotal section is in said first position, and said end conveyor section arranged in a substantially horizontal position when said pivotal section is in said second position.

7. An apparatus for handling disintegrated material as set forth in claim 6 which includes, a rigid arm member having one end portion pivotally mounted on one of said vertical plate members and the other end portion pivotally mounted on said vertical plate member positioned adjacent said end conveyor section to permit responsive movement of said end conveyor section upon movement of said pivotal section.

8. An apparatus for handling disintegrated material as set forth in claim 1 which includes, drill means, a pair of drill booms mounted forwardly of said elongated body members at each side thereof, said drill booms operable to rotate about the connection thereof to said elongated body member and to move said drill means in a vertical plane relative to said elongated body member.

* * * * *